US009340952B2

(12) United States Patent
Sasaki

(10) Patent No.: US 9,340,952 B2
(45) Date of Patent: May 17, 2016

(54) CONSTRUCTION MACHINE

(71) Applicant: KOBELCO CONSTRUCTION MACHINERY CO., LTD., Hiroshima-shi (JP)

(72) Inventor: Hirofumi Sasaki, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/531,232

(22) Filed: Nov. 3, 2014

(65) Prior Publication Data

US 2015/0125248 A1 May 7, 2015

(30) Foreign Application Priority Data

Nov. 7, 2013 (JP) ..... 2013-231154

(51) Int. Cl.

| | |
|---|---|
| ***B62D 23/00*** | (2006.01) |
| ***E02F 9/08*** | (2006.01) |
| ***E02F 3/32*** | (2006.01) |
| ***E02F 9/16*** | (2006.01) |

(52) U.S. Cl.

CPC ..... *E02F 9/0866* (2013.01); *E02F 3/32* (2013.01); *E02F 3/325* (2013.01); *E02F 9/16* (2013.01)

(58) Field of Classification Search

USPC ..... 180/41, 68.1, 68.2, 68.4, 89.1; 123/41.33, 41.48, 41.49, 41.65

See application file for complete search history.

(56) References Cited

U.S. PATENT DOCUMENTS

| | | | | |
|---|---|---|---|---|
| 5,816,350 | A * | 10/1998 | Akira | B60H 1/3227 180/68.1 |
| 6,390,770 | B1 * | 5/2002 | Takeshita | E02F 9/0866 415/119 |
| 6,922,925 | B2 * | 8/2005 | Watanabe | E02F 3/325 123/41.49 |
| 7,134,518 | B2 * | 11/2006 | Arai | B60K 11/04 180/68.1 |
| 7,182,164 | B2 * | 2/2007 | Merlo | B60K 11/04 180/68.1 |

(Continued)

FOREIGN PATENT DOCUMENTS

| | | |
|---|---|---|
| EP | 1 410 930 A1 | 4/2004 |
| EP | 2 500 542 A1 | 9/2012 |
| JP | 2005-146741 | 6/2005 |

OTHER PUBLICATIONS

Extended European Search Report issued Mar. 13, 2015 in Patent Application No. 14191833.4.

*Primary Examiner* — Toan To

(74) *Attorney, Agent, or Firm* — Oblon, McClelland, Maier & Neustadt, L.L.P

(57) ABSTRACT

Provided is a construction machine including an upper slewing body slewably mounted on a lower travelling body and an electric component attached to the upper slewing body. The upper slewing body includes an operator seat, a seat stand including a top plate portion having an upper surface on which the operator seat is placed, an engine disposed below the top plate portion, a heat exchanger disposed, with a space between the heat exchanger and the seat stand, on one outer side of the seat stand in a width direction; and a partition member disposed in the space to vertically partition the space so as to block upward transmission of heat of the engine. The electric component is disposed above the partition member and on the one outer side of the seat stand inside the upper slewing body.

5 Claims, 5 Drawing Sheets

(56) References Cited

U.S. PATENT DOCUMENTS

| | | | | |
|---|---|---|---|---|
| 7,451,843 | B2 * | 11/2008 | Nakashima | B60K 11/08 180/68.1 |
| 8,215,434 | B2 * | 7/2012 | Matsushita | B62D 49/085 180/68.1 |
| 8,550,198 | B2 * | 10/2013 | Isaka | B60K 11/04 180/291 |
| 8,651,219 | B2 * | 2/2014 | Yoshida | E02F 3/325 180/305 |
| 8,919,488 | B2 * | 12/2014 | Shiraishi | E02F 9/0866 180/309 |
| 8,936,127 | B2 * | 1/2015 | Kanamaru | E02F 9/0866 180/69.21 |
| 8,967,309 | B2 * | 3/2015 | Kimura | B60H 1/00378 180/68.1 |
| 9,027,676 | B2 * | 5/2015 | Nakashima | E02F 9/0866 123/41.56 |
| 2004/0074454 | A1 | 4/2004 | Mimuro et al. | |
| 2008/0257623 | A1 | 10/2008 | Yonetake et al. | |
| 2012/0234513 | A1 | 9/2012 | Watanabe | |

* cited by examiner

CONSTRUCTION MACHINE

TECHNICAL FIELD

The present invention relates to a construction machine.

BACKGROUND ART

Conventionally, there has been known a structure in which an electric component such as a mechatronic controller is installed to a rear side panel part of a box-type cab which is mounted on an upper slewing body of a hydraulic shovel. A working machine having such a structure is disclosed in Japanese Unexamined Patent Publication No. 2005-146741.

The disclosed working machine, in which the electric component is attached to the rear side plate portion of the cab, allows an operator to access the electric component from the outside of the cab, and allows a working space to be secured.

Meanwhile, in the case of a compact type of construction machine having a small slewing radius in a rear portion thereof, there is provided a mechatronic controller as the electric component below a seat stand on which the operator seat is mounted, in order to prevent from increase a total length of an electric wire routed from the monitor, the fuse box, and the like arranged in the operation space of the upper slewing body. However, the rearward-small slewing type construction machine, having an engine disposed under the seat stand, involves a problem of leaving the mechatronic controller to be easily subjected to influence of heat from the engine.

SUMMARY OF INVENTION

An object of the present invention is to provide a construction machine which can suppress influence of heat from the engine to the electric component.

A construction machine according to one aspect of the present invention includes: a lower travelling body; an upper slewing body slewably mounted on the lower travelling body; and an electric component to be installed to the upper slewing body. The upper slewing body includes: an operator seat; a seat stand including a top plate portion having an upper surface on which the operator seat is placed; an engine disposed under the top plate portion; a heat exchanger disposed on one outer side of the seat stand with respect to a width direction of the upper slewing body with a space between the heat exchanger and the seat stand; and a partition member disposed in the space to partition the space vertically so as to block upward transmission of heat of the engine. The electric component is disposed above the partition member and on the one outer side of the seat stand inside the upper slewing body.

DESCRIPTION OF EMBODIMENTS

There will be described below embodiments of the present invention with reference to the drawings. The description of the following preferred embodiments is basically not more than an exemplification, and is not intended to limit the present invention, an application target or a usage of the present invention. In each drawing, an up and down direction and a right and left direction are indicated by arrows. Except where particularly specified otherwise, the up and down and other directions will be described following the directions indicated by the arrows. The up and down direction, and the right and left direction are respective directions orthogonal to each other. The right and left direction corresponds to the width direction of the upper slewing body.

Figure 1:
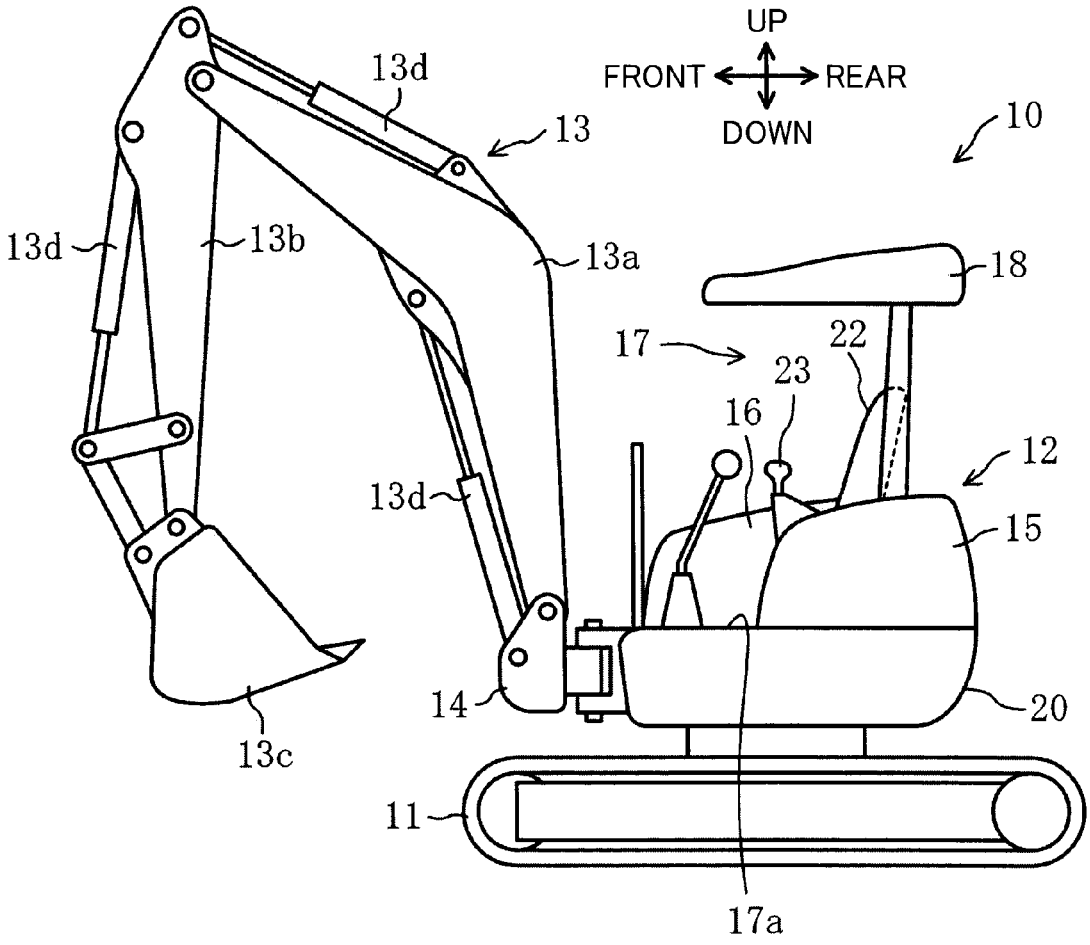
FIG. 1 is a side view of a construction machine according to one embodiment of the present invention.

FIG. 1 is a side view of a construction machine 10 according to one embodiment of the present invention. As shown in FIG. 1, the construction machine 10 is a compact model having a smaller slewing radius of a rear portion than that of a front portion. Specifically, the construction machine 10 is a hydraulic excavator. The construction machine 10 includes a crawler-type lower travelling body 11, and an upper slewing body 12 slewably mounted on the lower travelling body 11.

The upper slewing body 12 includes: a hood 18; an upper frame 20; an operator seat 22; an operation lever 23; a fuel tank, a hydraulic tank, and the like which are not graphically shown; an air intake duct 24; a heat exchanger 25; a fan shroud 26; a blowing fan 27; an engine 28; and a hydraulic pump 29.

Figure 3:
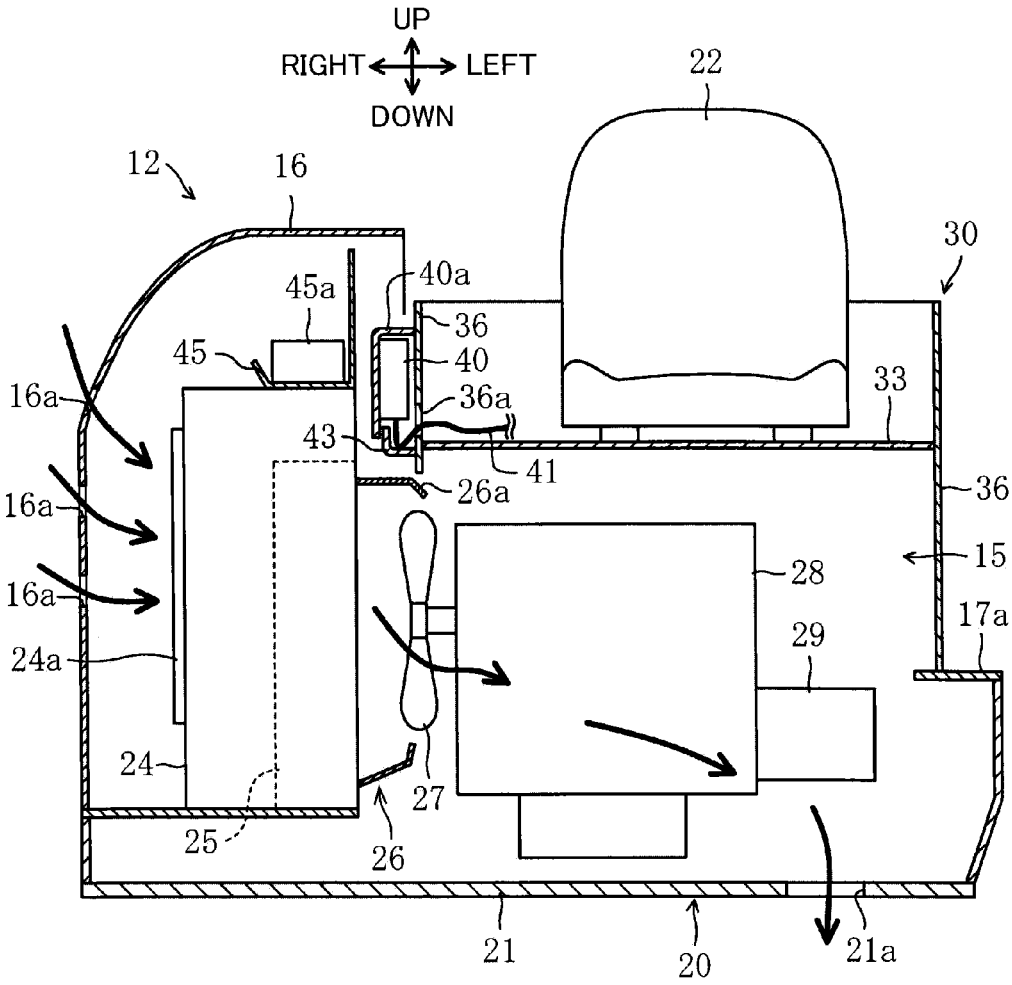
FIG. 3 is a front sectional view of an upper slewing body to show a structure for arrangement of a mechatronic controller.

The rear portion of the upper slewing body 12 is provided with an engine room 15 for accommodating equipment including the engine 28 (see FIG. 3). In a right portion of the upper slewing body 12, there is provided a side machine room 16 for accommodating the fuel tank, the hydraulic tank, and the like not graphically shown. In a left portion of the upper slewing body 12, there is provided an operation space 17, in which the operator seat 22 on which the operator is seated to operate the construction machine 10 and the operation lever 23 to which an operator applies a manipulation for operating the construction machine 10, and the like are installed. In an upper portion of the upper slewing body 12, the hood 18 is disposed so as to cover the operation space 17 at an upper side thereof.

The construction machine 10 also includes an attachment 13 mounted on a front part of the upper slewing body 12. The attachment 13 is located forward of the upper slewing body 12. The attachment 13 is supported on the front part of the upper slewing body 12 so as to be able to be raised, lowered and swung in the right and left direction. The attachment 13 is designed for performance of various works including an excavation work. The attachment 13 includes a boom 13*a*, an arm 13*b*, and a bucket 13*c*. The boom 13*a* has a basal end portion, which is pivotably attached to the upper slewing body 12 through a swing bracket 14 so as to be capable of rotational movement. The arm 13*b* is pivotably attached to a distal end of the boom 13*a*. The bucket 13*c* is pivotably attached to a distal end of the arm 13*b*.

In the present construction machine 10, upon application of operation to the operation lever 23 and the like, respective hydraulic cylinders 13*d* corresponding to the boom 13*a*, the arm 13*b* and the bucket 13*c* are extended and retracted, thereby raising and lowering the attachment 13. Besides, there is provided a not-graphically-shown swing cylinder, which is extended and retracted to thereby swing the attachment 13 in the right and left direction.

Figure 2:
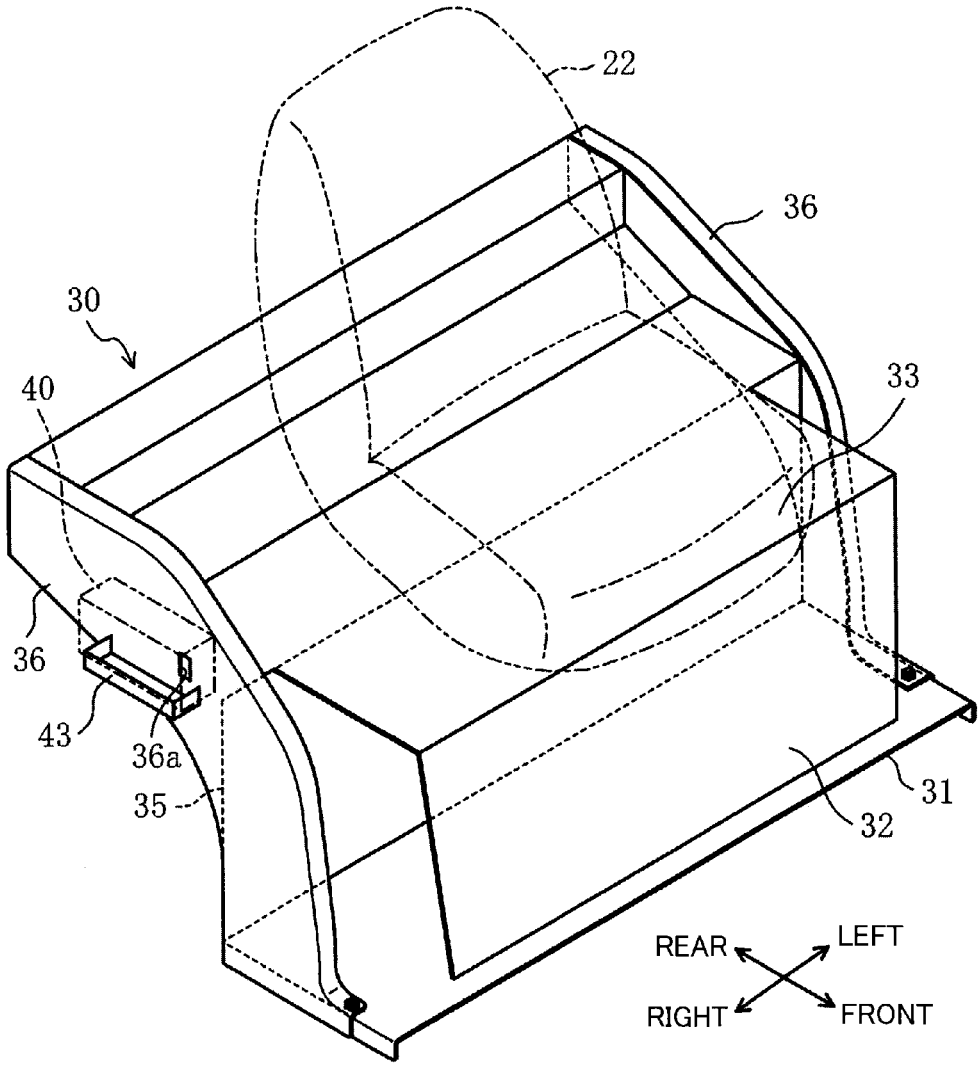
FIG. 2 is a perspective view of a seat stand.

As shown in FIG. 2 and FIG. 3, the seat stand 30 is mounted on the upper frame 20 of the upper stewing body 12. The seat stand 30 includes a bottom plate portion 31, a front plate portion 32, a top plate portion 33, a rear plate portion 35 and a pair of sidewall portions 36, which portions are integrated with each other to form the seat stand 30.

The bottom plate portion 31 is formed of an approximately rectangular and oblong plate body. The bottom plate portion 31 is assembled to the rear part of a floor surface 17*a* (see FIG. 1) of the operation space 17. The floor surface 17*a* is a surface defining the lower end of the operation space 17 out of the upper frame 20.

The front plate portion 32 is formed of an approximately rectangular and oblong plate body having a lateral size smaller than that of the bottom plate portion 31. The front plate portion 32 is arranged so as to extend in the right and left direction along the front edge of the bottom plate portion 31. The front plate portion 32 has a lower end edge, which is joined to the upper surface of the bottom plate portion 31. The front plate portion 32 is erected from the floor surface 17*a* of the operation space 17 so as to have a front surface facing the operation space 17.

The top plate portion 33 is formed of a plate body continuously joined to the upper end edge of the plate portion 32 and extended backward from the upper end edge of the front plate portion 32. The front plate portion 32 and the top plate portion 33 are formed of a single bent plate body. The top plate portion 33 is disposed approximately parallel to the bottom plate portion 31. The top plate portion 33 and the bottom plate portion 31 are vertically opposed to each other. The top plate portion 33 has an upper surface on which the operator seat 22 is placed. Specifically, the operator seat 22 is placed on an intermediate portion with respect to the right and left direction of the upper surface of the top plate portion 33.

The rear plate portion 35 is disposed at a lower side of the top plate portion 33. The rear plate portion 35 is disposed approximately parallel to the front plate portion 32 rearward of the front plate portion 32 with a distance. The rear plate portion 35 and the front plate portion 32 are opposed to each other.

The pair of sidewall portions 36 are distributed to respective right and left end portions of the seat stand 30, each standing up on the bottom plate portion 31. Each sidewall portion 36 is, therefore, vertically extended. Each sidewall portion 36 is formed of a strength member arcuately curved to have a front part protruding forward. The bottom plate portion 31, the top plate portion 33, and the rear plate portion 35 have respective left ends which are joined to the left sidewall portion 36 and respective right ends which are joined to the right sidewall portion 36. Thus, the respective left ends of the bottom plate portion 31, the top plate portion 33, and the rear plate portion 35 are joined together through the left sidewall portion 36, while the respective right ends of the bottom plate portion 31, the top plate portion 33, and the rear plate portion 35 are joined together through the right sidewall portion 36.

The engine 28 is arranged at a position between the pair of sidewall portions 36 and under the top plate portion 33. The upper frame 20 has a bottom plate 21, which is formed with an exhaust opening 21*a* making communication with the inside of the engine room 15.

The side machine room 16A has a right sidewall, which is formed with a plurality of air intake ports 16*a*. The space inside the machine room 16 and the engine room 15 form a continuous space. In the continuous space, disposed are the air intake duct 24, the heat exchanger 25 such as a radiator or an oil cooler for cooling the engine, the fan shroud 26, the blowing fan 27, the engine 28, and the hydraulic pump 29 in this order from an upstream side toward a downstream side in the flow direction of the air in the continuous space. Hereinafter, upstream with respect to the flow direction of the air in the continuous space will be called simply as the "upstream", and the downstream with respect to the flow direction of the air will be called simply as the "downstream".

The air intake duct 24 has an upstream end, which is attached with an air filter 24*a*. The heat exchanger 25 is provided downstream of the air intake duct 24 and on one outer side of the seat stand 30 in the right and left direction. Specifically, the heat exchanger 25 is provided at the right side of the seat stand 30. Besides, the heat exchanger 25 is disposed with a space between the seat stand 30 and the heat exchanger 25.

The fan shroud 26 is formed of a cylindrical member extended from the downstream surface of the heat exchanger 25 toward the engine 28. The fan shroud 26 surrounds the blowing fan 27 to cover it. The fan shroud 26 is disposed in such a posture that the axial center thereof extends along the rotation axis of the blowing fan 27. The fan shroud 26 is provided in the space between the heat exchanger 25 and the seat stand 30. The fan shroud 26 forms a partition member which vertically partitions the space between the heat exchanger 25 and the seat stand 30 so as to block upward transmission of heat of the engine. Specifically, the fan shroud 26 has a partition part 26*a* which vertically partitions the space between the heat exchanger 25 and the seat stand 30. The partitioning part 26*a* is a part of the cylindrical fan shroud 26, the part being located at a position higher than the upper end of the engine 28.

The blowing fan 27 is operated to introduce outer air into the space in the side machine room 16 through the air intake ports 16*a*. The introduced outer air passes through the air filter 24*a* to cause dusts therein to be removed by the air filter 24*a*, thereafter passing through in the air intake duct 24 to be subjected to heat exchange in the heat exchanger 25. The heat-exchanged air is blown out toward the engine 28 through the fan shroud 26, thereby cooling the engine 28 and the hydraulic pump 29. The air having cooled the engine 28 and the hydraulic pump 29 is discharged downward through the exhaust opening 21*a* formed on the bottom plate 21 of the upper frame 20, as shown by thick-line arrows in FIG. 3.

In the operation space 17 are provided a monitor, a fuse box, and the like, which are not graphically shown. The construction machine 10 includes a mechatronic controller 40 which is an electric component for controlling the monitor, the fuse box, and the like. The mechatronic controller 40 is installed to the upper slewing body 12 and connected with an electric wire 41.

For preventing the electric wire 41 from having an increased total length, the mechatronic controller 40 is disposed at a position near the seat stand 30. Besides, it is preferable that the mechatronic controller 40 is arranged at a position where the mechatronic controller 40 is not likely to receive influence of the heat from the engine 28.

Specifically, the mechatronic controller 40 in the present embodiment is located above the fan shroud 26 inside the upper slewing body 12. In detail, the mechatronic controller 40 is located upward of the partitioning part 26*a*. Besides, the mechatronic controller 40 is located at the right side (at the heat exchanger 25 side) of the seat stand 30. Specifically, the sidewall portion 36 at the right side (at the heat exchanger 25 side) of the seat stand 30 has an outer surface facing the heat-exchanger-25 side, and the mechatronic controller 40 is detachably attached to the outer surface. The mechatronic controller 40 is mounted on the outer surface of the right sidewall portion 36, at a position near the upper part of the heat exchanger 25.

The mechatronic controller 40 has an upper surface, a pair of side surfaces (namely, a front side surface and rear side surface), and a back surface (a right side surface), which surfaces are covered with a box-shaped cover member 40*a*. The mechatronic controller 40 is joined to the cover member 40*a*. The mechatronic controller 40 is detachably attached to the right sidewall portion 36, by co-fastening the cover member 40*a* and the right sidewall portion 36 with a fastening bolt and a fastening nut not shown. In summary, the mechatronic controller 40 is detachably attached to the right sidewall portion 36 via the cover member 40*a*, causing the front surface (the left side surface) of the mechatronic controller 40 to be covered with the sidewall portion 36 on the right side. The lower surface of the mechatronic controller 40 is covered with an accommodation tray 43 to be described later. Thus surrounding the mechatronic controller 40 by the cover member 40*a*, the sidewall portion 36, and the accommodation tray 43 to cover it enables the mechatronic controller 40 to be protected from rainwater and dusts.

In addition, attaching the mechatronic controller 40 to the outer surface of the right sidewall portion 36 of the seat stand 30 at a position above the fan shroud 26 allows the partitioning part 26*a* of the fan shroud 26, the seat stand 30, the air intake duct 24, and the like to block the transmission of the heat of the engine 28 to the space in which the mechatronic controller 40 is disposed; this makes it possible to suppress the influence of the heat to the mechatronic controller 40.

Besides, since the mechatronic controller 40 is arranged at a position near the upper part of the heat exchanger 25 and above the fan shroud 26, the fan shroud 26 can suppress transmission of the heat of the engine 28 to the mechatronic controller 40, by forming the airflow from the heat exchanger 25 toward the engine-28 side. In addition, disposition of the mechatronic controller 40 at the position near the upper part of the heat exchanger 25 allows the heat exchanger 25 to be prevented from hindering detachment of the mechatronic controller 40 from the seat stand 30 by pulling the mechatronic controller 40 upward and attachment of the mechatronic controller 40 on the seat stand 30 by lowering the mechatronic controller 40. This enables the maintenance of the mechatronic controller 40 to be easily performed.

The mechatronic controller 40 and the not-graphically-shown monitor are interconnected through the electric wire 41. The right sidewall portion 36 is formed with a routing hole 36*a* for allowing the electric wire 41 to be inserted through the routing hole 36*a* to be routed. The routing hole 36*a* is a vertically long hole. Specifically, the routing hole 36*a* has a vertical size greater than a size thereof in the front and rear direction orthogonal to the vertical direction and the right and left direction. This allows the electric wire 41 to be moved upward along the internal peripheral edge of the routing hole 36*a* when the mechatronic controller 40 is pulled obliquely upward, thus restraining the electric wire 41 from being caught by the routing hole 36*a* and allowing the mechatronic controller 40 to be smoothly detached.

The outer surface of the right sidewall portion 36 has a part located below the routing hole 36*a*, to which part the accommodation tray 43 having a box shape defining the upward opened accommodation space is attached. The accommodation tray 43 is extended in the front and rear direction. In the accommodation space of the accommodation tray 43, the electric wire 41 drawn to the outer side (the right side) of the right sidewall portion 36 through the routing hole 36 and the connector 42 are accommodated. The accommodation tray 43, thus accommodating in the accommodation space a surplus portion of the electric wire 41 drawn out from the right sidewall portion 36 and the connector 42, can prevent the electric wire 41 from being hung down to thereby prevent the electric wire 41 from disconnection while facilitating the maintenance work of the mechatronic controller 40.

The upper slewing body 12 includes a placement base 45 on which a tool box 45*a* can be placed. The mounting base 45 is disposed rightward of the mechatronic controller 40. The mounting base 45 is allocated at a position upward of the heat exchanger 25 and at a position allowing the mounting base 45 to overlap the mechatronic controller 40 in the width direction of the upper slewing body 12. This enables the mounting base 45 to first receive an impact, which can be given from the outside due to rollover of the construction machine 10 or the like, thereby preventing the impact from being directly exerted on the mechatronic controller 40.

Figure 4:
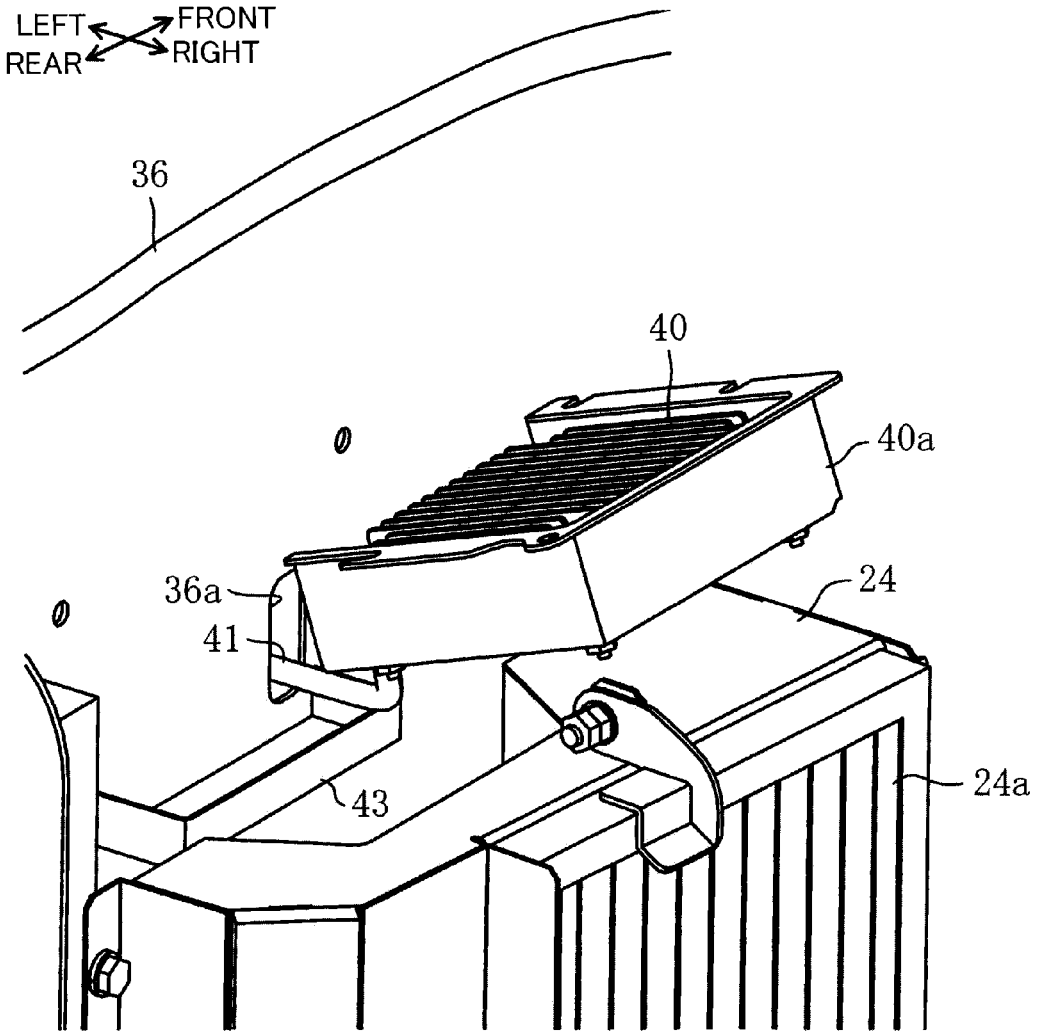
FIG. 4 is a perspective view of a part of the seat stand near the mechatronic controller in a state where the mechatronic controller is taken away from the seat stand.

For performing the maintenance of the mechatronic controller 40, the mounting base 45 is firstly detached to expose the mechatronic controller 40. The mechatronic controller 40, which is attached to the sidewall portion 36 of the seat stand 30 by the attachment of the cover member 40*a* to the sidewall portion 36 with the fastening bolt not shown, can be detached integrally with the cover member 40*a* from the sidewall portion 36 by loosening and unfastening the fastening bolt (see FIG. 4).

Figure 5:
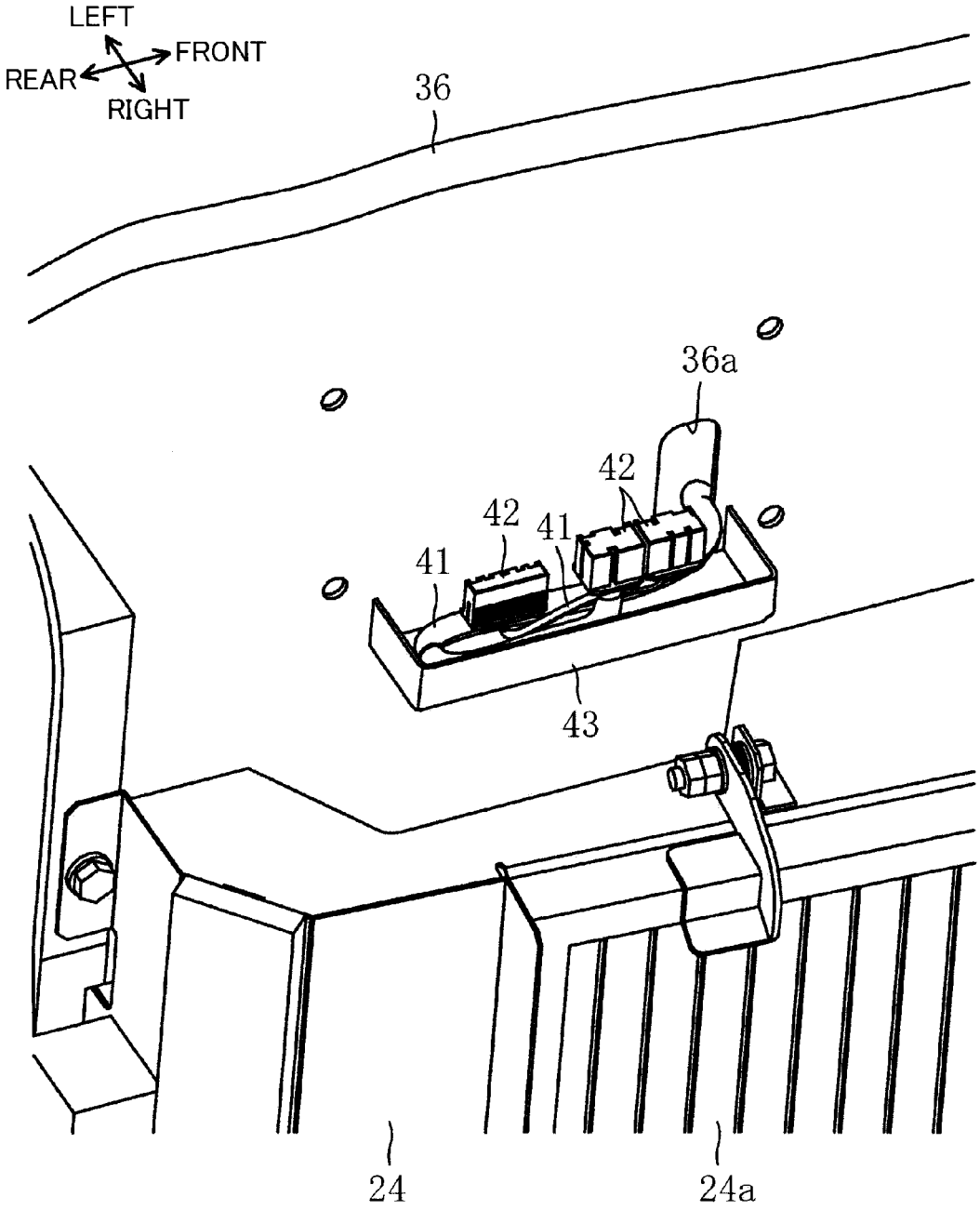
FIG. 5 is a perspective view of a portion near an accommodation tray to show a state of accommodation of an electric wire in an accommodation space in an accommodation tray.

When an operator staying at the right side of the mechatronic controller 40 draws the mechatronic controller 40 to a position in front of the operator, the electric wire 41 and the connector 42 (see FIG. 5) are drawn out to the right side of the sidewall portion 36 through the routing hole 36*a* of the sidewall portion 36. Then, the mechatronic controller 40 can be detached from the connector 42 of the electric wire 41. The electric wire 41 and the connector 42 drawn out to the right side of the sidewall portion 36 can be accommodated in the accommodation space in the accommodation tray 43 as shown in FIG. 5.

Attaching the mechatronic controller 40 to the sidewall portion 36 of the seat stand 30 can be achieved by a reverse procedure to the above procedure. Hence, the description of the attachment work is omitted. During the attachment work, the electric wire 41 and the connector 42 are being accommodated in the accommodation space of the accommodation tray 43, which allows the electric wire 41 to be easily connected to the mechatronic controller 40 while preventing the electric wire 41 from being sandwiched between the mechatronic controller 40 and the right sidewall portion 36.

Other Embodiments

The above embodiment may be modified, for example, as follows.

The engine 28, which is disposed in the region between the pair of sidewall portions 36 in the width direction of the slewing body 12 in the above embodiment, may be arranged so as to have a part protruding outward beyond the sidewall portion 36 in the width direction.

While the above embodiment includes the utilization of the fan shroud 26 as a partition member for vertically partitioning the space between the seat stand 30 and the heat exchanger 25, the present invention is not limited to the embodiment. For example, there may be used a partitioning plate other than the fan shroud 26 for vertical partition of the space between the seat stand 30 and the heat exchanger 25.

SUMMARY OF THE EMBODIMENT

The above embodiment can be summarized as follows.

The construction machine according to the above embodiment includes: a lower travelling body; an upper slewing body slewably mounted on the lower travelling body; and an electric component to be installed to the upper slewing body. The upper slewing body includes: an operator seat; a seat stand including a top plate portion having an upper surface on which the operator seat is placed; an engine disposed under the top plate portion; a heat exchanger disposed on one outer side of the seat stand with respect to a width direction of the upper slewing body with a space between the heat exchanger and the seat stand; and a partition member disposed in the space to partition the space vertically so as to block upward transmission of heat of the engine. The electric component is disposed above the partition member and on the one outer side of the seat stand inside the upper slewing body.

According to the construction machine, the space between the seat stand and the heat exchanger is vertically partitioned by the partition member and the electric component is disposed above the partition member inside the upper slewing body and also at the one outer side of the seat stand with respect to the width direction of the upper slewing body; this enables the partition member to block the upward transmission of the heat of the engine to the electric component, thereby suppressing the influence of the heat to the electric component. Besides, the partition member can form the flow of the air from the heat exchanger toward the engine side to thereby also suppress the transmission of the heat of the engine to the electric component.

In the above construction machine, it is preferable that: the seat stand has a sidewall portion disposed on the heat exchanger side and vertically extended to be joined to the top plate portion; the sidewall portion has an outer surface facing the heat exchanger side; and the electric component is detachably attached to the outer surface of the sidewall portion.

With this configuration, the electric component is detachably attached to the outer surface of the side wall part of the seat stand above the partition member, that is, the electric component is disposed at a position near the upper part of the heat exchanger; this prevents the heat exchanger from hindering detachment of the electric component from the seat stand with drawing the electric component upward and attachment of the electric component on the seat stand with lowering the electric component. The maintenance of the electric component is thus allowed to be easily performed.

In this case, it is preferable that: the electric component is connected with an electric wire; the sidewall portion is formed with a routing hole through which the electric wire is passed; the outer surface of the sidewall portion has a part located below the electric component; and the part is provided with an accommodation tray which defines an accommodation space opened upward to accommodate the electric wire.

In the above configuration, while the electric wire connected to the electric component is routed through the routing hole on the sidewall portion, the accommodation tray disposed on the outer surface of the sidewall portion can prevent the electric wire from being hung down, by accommodating in the accommodation space a surplus portion of the electric wire drawn out from the side wall portion and the connector, thereby facilitating the maintenance work of the electric component while preventing the electric wire from a disconnection and the like.

In this case, it is further preferable that the routing hole is a vertically long hole.

The vertically long routing hole allows the electric component to be taken out smoothly from the sidewall portion. Specifically, although the electric wire, which is connected to the electric component and routed through the routing hole, is pulled upward when the electric component is pulled obliquely upward in order to perform the maintenance of the electric component, the vertically long routing hole can permit the electric wire to move upward along the internal peripheral edge of the routing hole to thereby restrain the electric wire from being caught by the routing hole, thus enabling the electric component to be detached smoothly.

In the construction machine, it is preferable that the upper slewing body further includes a placement base allowing a tool box to be placed on the placement base, the placement base being disposed at a position at an outer side of the electric component in the width direction of the upper slewing body, the position making the placement base overlap the electric component in the width direction.

The placement base, thus disposed at the position outside the electric component in the width direction to overlap the electric component in the width direction, prevents an operator from erroneous contact with the electric component. Besides, the placement base can receive an impact due to rollover or the like firstly to prevent the impact from being directly exerted on the electric component.

As described above, according to the above embodiment, where the partition member vertically partitions the space between the seat stand and the heat exchanger and the electric component is disposed above the partition member inside the upper slewing body and on one outer side of the seat stand in the width direction of the upper slewing body, the partition member can block the transmission of heat of the engine to the electric component, thus suppressing the influence of the heat to the electric component. Besides, the partition member, forming the flow of the air from the heat exchanger toward the engine side, can suppress the transmission of the heat of the engine to the electric component.

The present invention, which allows a highly practical effect of enabling the electric component to be disposed at a position allowing the operator to easily perform the maintenance of the electric component while suppressing the influence of the heat from the engine to the electric component, is remarkably useful and has high industrial applicability.

This application is based on Japanese Patent application No. 2013-231154 filed in Japan Patent Office on Nov. 7, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a lower travelling body;

an upper slewing body slewably mounted on the lower travelling body; and an electric component to be installed to the upper slewing body, wherein the upper slewing body includes:

an operator seat;

a seat stand including a top plate portion having an upper surface on which the operator seat is placed;

an engine disposed under the top plate portion;

a heat exchanger disposed on one outer side of the seat stand with respect to a width direction of the upper slewing body with a space between the heat exchanger and the seat stand; and a partition member disposed in the space to partition the space vertically so as to block upward transmission of heat of the engine, and wherein the electric component is disposed above the partition member and on the one outer side of the seat stand inside the upper slewing body, the seat stand has a sidewall portion disposed on the heat exchanger side and vertically extended to be joined to the top plate portion;

the sidewall portion has an outer surface facing the heat exchanger side; and the electric component is attached to the outer surface of the sidewall portion.

2. The construction machine according to claim 1, wherein:

the electric component is detachably attached to the outer surface of the sidewall portion.

3. The construction machine according to claim 2, wherein:

the electric component is connected with an electric wire;

the sidewall portion is formed with a routing hole through which the electric wire is passed; and the outer surface of the sidewall portion has a part located below the electric component, the part being provided with an accommodation tray which defines an accommodation space opened upward to accommodate the electric wire.

4. The construction machine according to claim 3, wherein the routing hole is a vertically long hole.

5. The construction machine according to claim 1, wherein:

the upper slewing body further includes a placement base allowing a tool box to be placed on the placement base; and the placement base is disposed at a position at an outer side of the electric component in the width direction of the upper slewing body, the position making the placement base overlap the electric component in the width direction.

* * * * *